United States Patent [19]

Freeze

[11] 4,414,791

[45] Nov. 15, 1983

[54] RIDING SADDLE

[76] Inventor: Eugene A. Freeze, 18211 Lost Knife Cir., #302, Gaithersburg, Md. 20760

[21] Appl. No.: 286,478

[22] Filed: Jul. 24, 1981

[51] Int. Cl.[3] ..... B68C 1/04

[52] U.S. Cl. ..... 54/44; 54/46

[58] Field of Search ..... 54/37, 44, 45, 46

[56] References Cited

U.S. PATENT DOCUMENTS

| | | | |
|---|---|---|---|
| 9,386 | 11/1852 | Mardock | 54/44 |
| 15,744 | 9/1856 | Plant | 54/44 |
| 248,514 | 10/1881 | Shelly | 54/44 |
| 2,739,434 | 3/1956 | Bell | 54/46 |

FOREIGN PATENT DOCUMENTS

| | | | |
|---|---|---|---|
| 3709 | of 1891 | United Kingdom | 54/44 |
| 2310 | of 1893 | United Kingdom | 54/44 |

*Primary Examiner*—Robert P. Swiatek

*Attorney, Agent, or Firm*—Roylance, Abrams, Berdo & Farley

[57] ABSTRACT

In riding saddles of the type comprising a seat structure and two side flaps each depending from a different side of the seat structure, the flaps are made adjustable in such fashion that each flap can be secured selectively in a forward position, suitable for jumping with shortened stirrups, an intermediate position, appropriate for pleasure or trail riding, and a rearward position, for dressage with lengthened stirrups.

23 Claims, 28 Drawing Figures

RIDING SADDLE

The invention relates to riding saddles of that general type comprising a seat structure and two flexible side flaps each secured to and depending from a different side of the seat structure.

BACKGROUND OF THE INVENTION

Saddles of the general type referred to are well known and, particularly when of the low pommel configuration characterizing the so-called English saddle, have long been accepted as the saddle of choice for competitive dressage and jumping as well as for pleasure and trail riding, in many parts of the world. Though such saddles vary widely as to specific form and details of construction, those disclosed in the following patents are representative:

British No. 1,945 of 1905
U.S. Pat. No. 567,278, Martin
U.S. Pat. No. 909,385, Fachiri
U.S. Pat. No. 3,286,440, Walker
U.S. Pat. No. 3,641,739, Stubben Such saddles are intended to provide a secure seat for the rider, with the rider's legs occupying generally the same positions, relative to the horse, at all times during a particular type (e.g., dressage or jumping) of riding conditions, and also to provide the rider with good opportunity to apply directive "aids" to the horse via leg contact. To improve comfort of the rider and to assist in maintaining the rider's legs in proper position, such saddles have been provided with built-up frontal portions, on either the flap or an additional panel underlying the flap, the built-up portions constituting "knee rolls", and prior art workers have also endeavored to make the flaps of such shape and extent as to assure that a portion of the flap will always be engaged by the rider's leg. Though such saddles heretofore available have achieved wide acceptance, two problems and encountered in the trade, the first because the size and proportions of riders vary widely, the second because of the different requirements posed by, e.g., use of the saddle for jumping and use for dressage. The first problem centers on the fact that the position of the flaps relative to the seat structure, while perfect for one rider, may be quite inappropriate for a rider of different size and proportions or a rider preferring a different stirrup length. The second problem arises because of the fact that the flaps should be in a distinctly different position, relative to the seat structure, for jumping than when the saddle is to be used for dressage.

Prior art workers have attempted to respond to these problems by designing an "all purpose" saddle, useful both for dressage and jumping as well as for pleasure and trail riding. Unfortunately, such efforts have resulted in saddles which are not really optimum for any specific purpose. Accordingly, there has been a continuing need for improvement.

OBJECTS OF THE INVENTION

A general object of the invention is to provide a saddle which is adjustable, at the choice of the rider, to be optimum for jumping, pleasure and trail riding, or dressage.

Another object is to devise a saddle which can be adjusted to suit the size, proportions and stirrup length preference of the rider.

A further object is to provide a saddle in which the flaps, and the knee rolls when knee rolls are employed, can be adjusted to suit the rider.

Yet another object is to provide a saddle in which the flaps are adjustable for jumping, pleasure and trail riding, and dressage in such fashion that, once adjusted, the saddle will present the flap under the leg of the rider at all times during the type of riding for which the saddle has been adjusted.

A still further object is to devise a saddle having padded panels of the extended type and adjustable flaps in such fashion that the extended portions of the panels automatically match the adjusted positions of the flaps and assure proper distribution of the weight applied from the saddle to the horse's back.

Another object is to provide a saddle in which the side flaps are detachable.

SUMMARY OF THE INVENTION

Saddles according to the invention comprise a seat structure including a tree. Two flaps each depend from a different side of the seat structure and each has a body portion, adapted to lie between the corresponding side of the horse and the rider's leg, and at least one upper portion. The saddle further includes fastener means for each of the flaps, the fastener means including at least one releasable fastener and being constructed and arranged to secure the flap to the seat structure to maintain the flap selectively in a forward position, appropriate for jumping with shortened stirrups, a rearward position, appropriate for dressage with lengthened stirrups, and at least one intermediate position appropriate for pleasure and trail riding, the main body of the flap being of such dimensions and configuration as to lie beneath the rider's leg when the flap is secured in any of the selected positions. In particularly advantageous embodiments, the fastener means includes two fasteners, one defining a pivot point about which the flap can be pivotally adjusted between the forward and rearward extreme positions, the other being a releasable fastener which when released allows the flap to be pivoted and when secured fixes the flap in its adjusted position. In other embodiments, the flap is moved bodily forwardly and rearwardly along a line extending generally lengthwise of the saddle, then secured in its adjusted position. When the flap is pivotally adjustable, the pivot point can be at an upper portion of the flap adjacent the leading edge, and a releasable fastener can then be provided in a second upper portion spaced rearwardly thereof, to secure the flap in its adjusted position. Alternatively, the pivot point and releasable fastener can be reversed. In other embodiments, the flap can be pivoted at an upper flap portion intermediate the front and rear edges, and a releasable fastener can be provided adjacent the forward edge or the rearward edge or both. Instead of providing one fastener which defines a true pivot point, two fasteners can be employed which are both releasable securing devices and are each associated with, e.g., arcuate slots centered on the point about which the flap is to be pivoted.

IDENTIFICATION OF THE DRAWINGS

Particularly advantageous embodiments of the invention will be described with reference to the accompanying drawings, wherein.

DETAILED DESCRIPTION OF THE INVENTION

Figure 1:
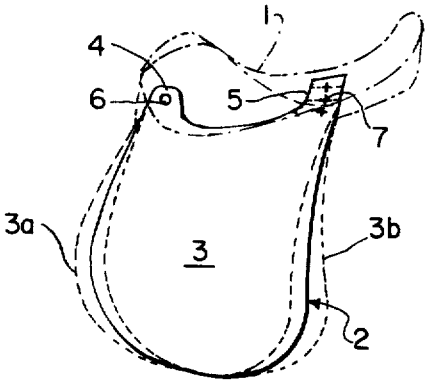
FIGS. 1-1C are diagrammatic side elevational views of saddles in accordance with four different embodiments of the invention.
Figure 1A:
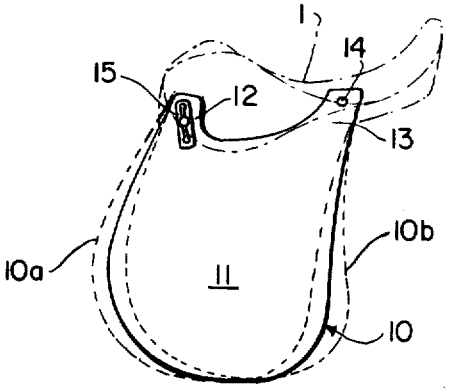
Figure 1B:
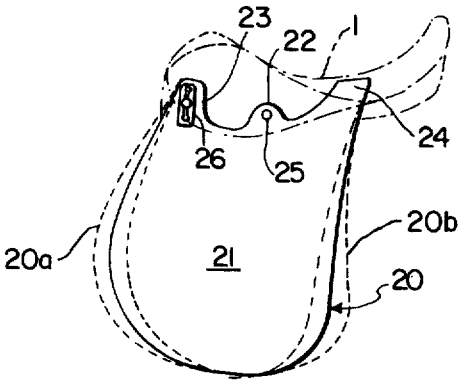
Figure 1C:
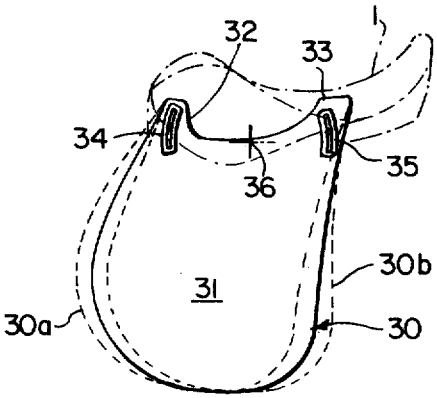

General Features of the Embodiments of FIGS. 1-1C

FIGS. 1-1C illustrate saddles constructed in accordance with four different embodiments of the invention. In each embodiment, the saddle comprises a seat structure 1, of generally conventional construction and including a conventional tree (not shown in FIGS. 1-1C), with two flaps secured to the seat structure, each flap being disposed on a different side of the seat structure and depending therefrom in a position to lie between the side of the horse and the leg of the rider.

In the embodiment of FIG. 1, flap 2 includes a body portion 3, a forward upper portion 4 and a rear upper portion 5, portions 4 and 5 being generally in the nature of tabs projecting from the upper edge of the flap, as shown. Forward portion 4 is pivoted to the seat structure at 6, as later described in detail with reference to FIGS. 5 and 6. Rear portion 5 is releasably secured to the seat structure at 7, as described in detail with reference to FIGS. 7-9, a fastener extending through any selected one of a plurality of apertures in portion 5 in such fashion that, with the fastener released, the flap can be pivoted between a forward position, illustrated in broken lines at 3*a* and suitable when the saddle is used with shortened stirrups for jumping, and a rearward position, shown in broken lines at 3*b* and appropriate for dressage with lengthened stirrup. The solid-line illustration of the flap, intermediate between the jumping position and the dressage position, in appropriate for pleasure or trail riding. The releasable fastener at 7 is tightened after the flap has been pivotally adjusted, and the pivotal connections at 6 and the fixed fasteners at 7 then serve to secure the flaps against all forces encountered during riding.

In the embodiment of FIG. 1A, the saddle employs seat structure 1 and flaps 10, arranged generally as described with reference to FIG. 1, and having a main body portion 11, a forward upper portion 12 and a rear upper portion 13. Here, rear upper portion 13 of each flap is pivoted to the seat structure at 14. A releasable fastener comprising a slotted plate 15 secured to upper portion 12 at the front of the flap allows pivoting of the flap when the fastener is released and can be tightened to secure the flap in its adjusted position. Thus, the flap can be in a forward position, for jumping, as indicated by broken lines at 10*a*, a rearward position appropriate for dressage, indicated at 10*b*, or an intermediate position suitable for pleasure or trail riding, shown in solid lines.

In the embodiment of FIG. 1B, seat structure 1 is again employed, and the saddle includes two side flaps 20 each having a main body portion 21, an intermediate upper portion 22, a forward upper portion 23 and, if desired, a rear upper portion 24. Upper portion 22 of the flap is pivoted to the seat structure at 25. As in the embodiment of FIG. 1A, forward upper portion 23 is equipped with a releasable fastener including slotted plate 26. If desired, a second releasable fastener (not shown) can be provided at rear upper portion 24. With the fastener or fasteners released, the flap can be pivoted to the forward position indicated at 20*a*, for jumping, or to the rearward position 20*b*, for dressage, or can occupy the intermediate position shown in solid lines, for pleasure or trail riding.

Figure 5:
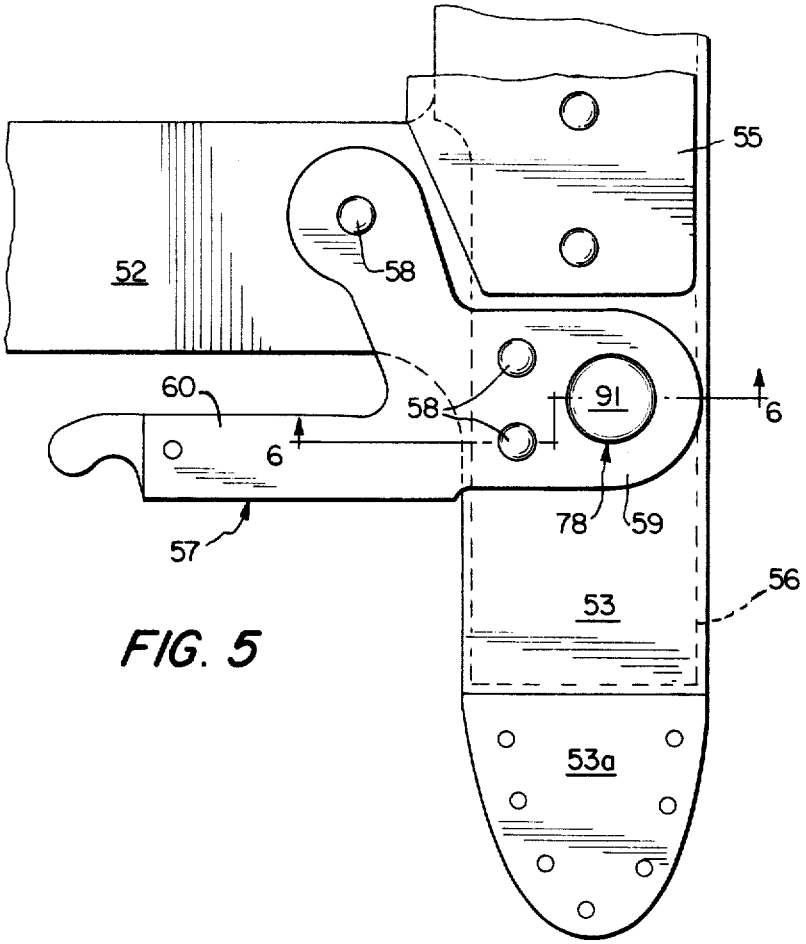
FIG. 5 is a fragmentary side elevational view of a portion of the head of the tree of the saddle of FIG. 2, with all leather parts of the saddle omitted but with a pivot fastener for the flap included.
Figure 6:
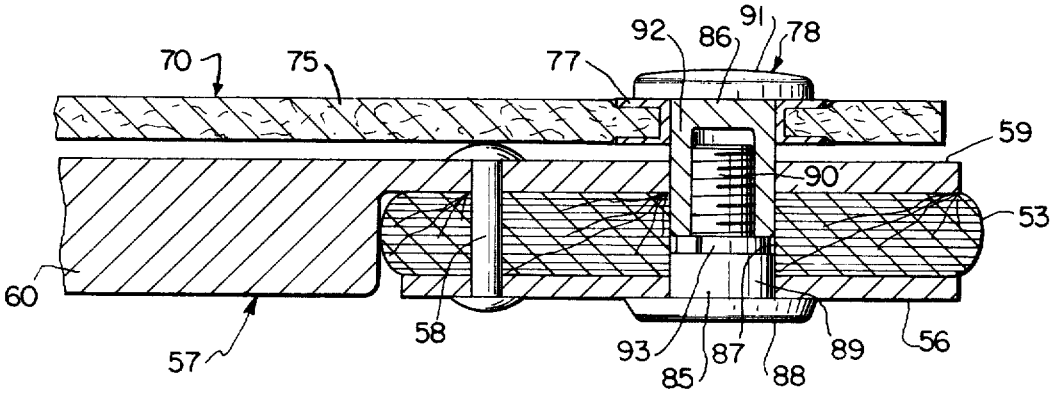
FIG. 6 is a fragmentary sectional view taken generally on line 6—6, FIG. 5, but with the flap in place.

In the embodiments seen in FIGS. 1-1B, a true pivotal connection between the flap and the seat structure, such as the connection described in detail with reference to FIGS. 5 and 6, is employed. In the embodiment shown in FIG. 1C, the true pivot is eliminated, the capability of pivotal adjustment being provided by equipping both the forward and rearward upper portions of the flap with releasable fasteners comprising an arcuately slotted plate. Here, the saddle again employs seat structure 1 and two side flaps 30, each flap including a main body portion 31, an upper forward portion 32 and an upper rear portion 33. Forward upper portion 32 is secured to the seat structure by a releasable fastener comprising a plate 34 which is fixed to portion 32 and presents an arcuate slot. Portion 33 is similarly equipped with a fastener comprising an arcuately slotted plate 35. One suitable form of such fasteners is later described in detail with reference to FIGS. 22-23. The two fasteners are so arranged that the slots of plates 34, 35 are aligned on a common circle with the center of the circle located, e.g., at point 36. Accordingly, with both fasteners released, the flap can be pivoted about point 36 in order to adjust the flap to the forward position, indicated by broken lines at 30*a*, to the rearward position indicated at 30*b*, or to the intermediate position shown in solid lines.

In considering FIGS. 1-1C, it is to be understood that the views are diagrammatic, the flaps being shown for clarity as if they were flat, and details of the seat structure being omitted.

The Embodiment of FIGS. 2-9

One particularly advantageous form of the saddle shown diagrammatically in FIG. 1 is illustrated in FIGS. 2-9. As will be understood from FIGS. 2, 4-6 and 9, seat structure 51 is of generally conventional form, including the usual spring tree having side members 52, FIGS. 5 and 9, and a head 53, FIGS. 5 and 6, the entire tree being formed of laminated wood, an additional underlying spring metal strip 54, FIG. 9, extending along and being secured to the side members, and the head being reinforced by upper and lower metal pieces 55 and 56, respectively, as seen in FIGS. 5 and 6. Two stirrup bars 57, FIGS. 5 and 6, are employed, each rigidly secured, as by rivets 58, to both the head 53 and the adjacent portion of the respective side member 52 of the tree. Stirrup bars 57 are integral metal pieces of generally conventional form and include flat forward portions 59 which are thinner than the main bodies 60 and extend across the outer surface of head 53 in a location adjacent the lower end of metal piece 55 and above the adjacent tips 53*a* of the point of the head.

Figure 2:
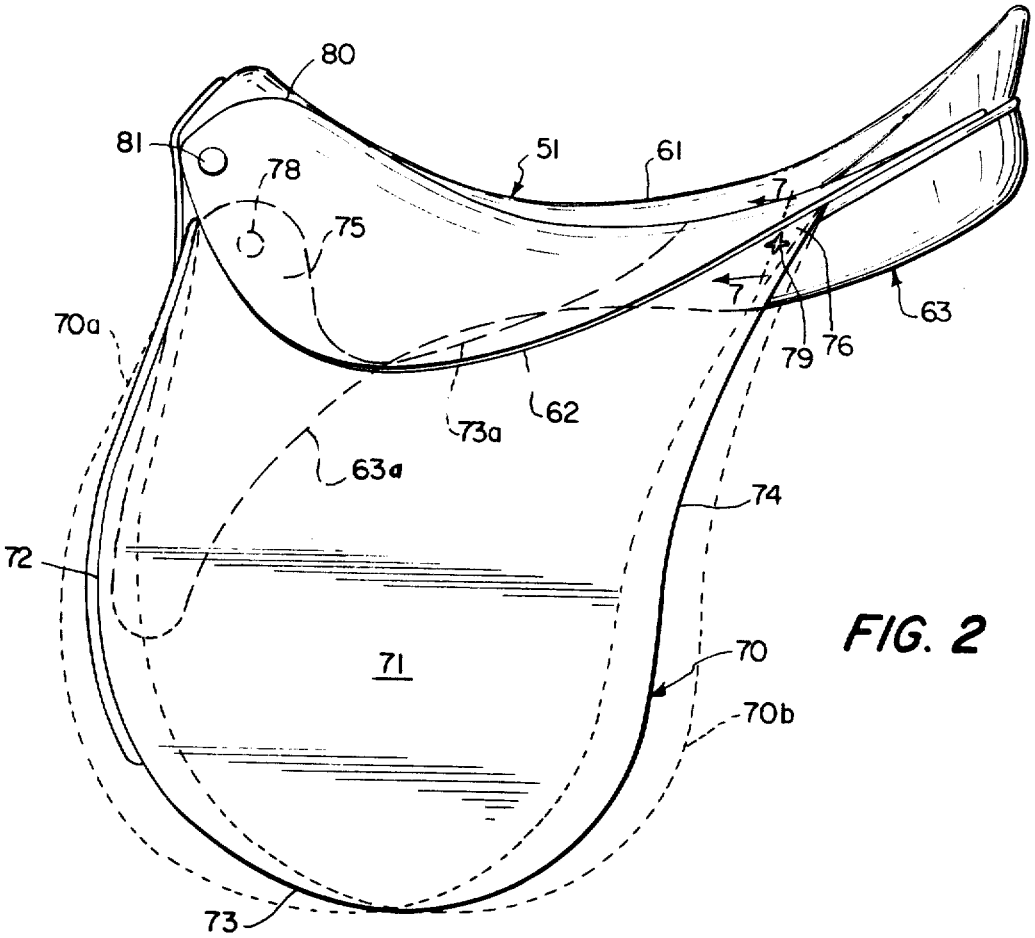
FIG. 2 is a side elevational view of a saddle constructed in accordance with the embodiment of FIG. 1.
Figure 9:
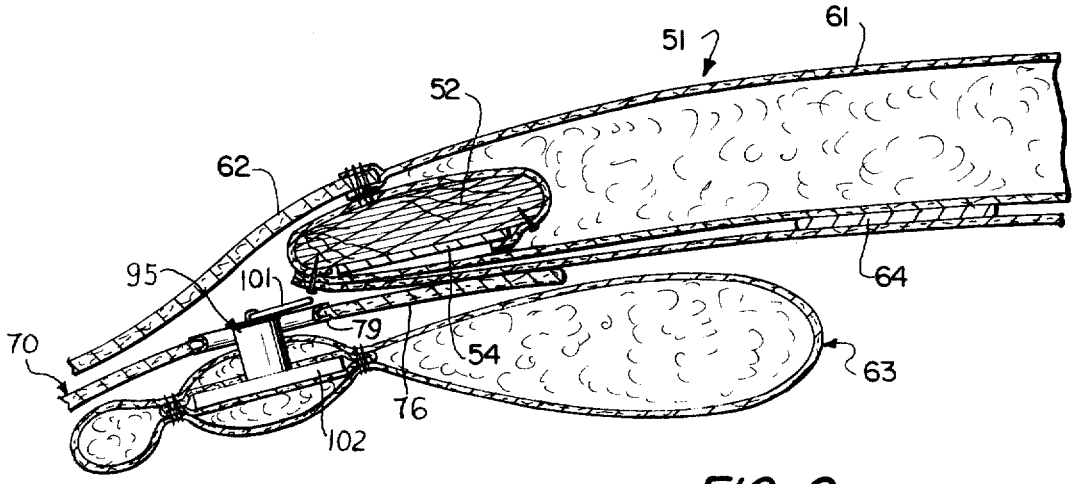
FIG. 9 is a fragmentary sectional view of the structure shown in FIG. 7, FIG. 9 being on a smaller scale than FIG. 7 and showing additional portions of the saddle.
Figure 4:
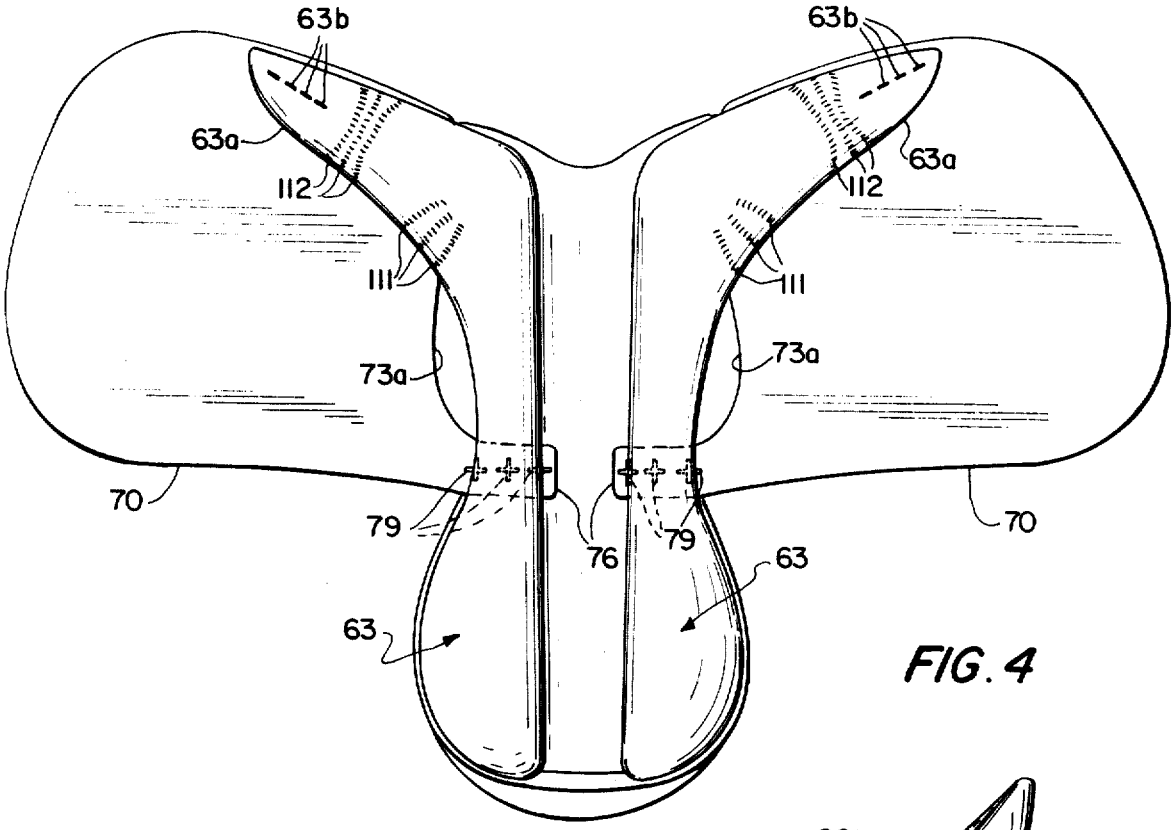
FIG. 4 is a bottom plan view of the saddle of FIG. 2, with the flaps and panels spread outwardly.
Figure 14:
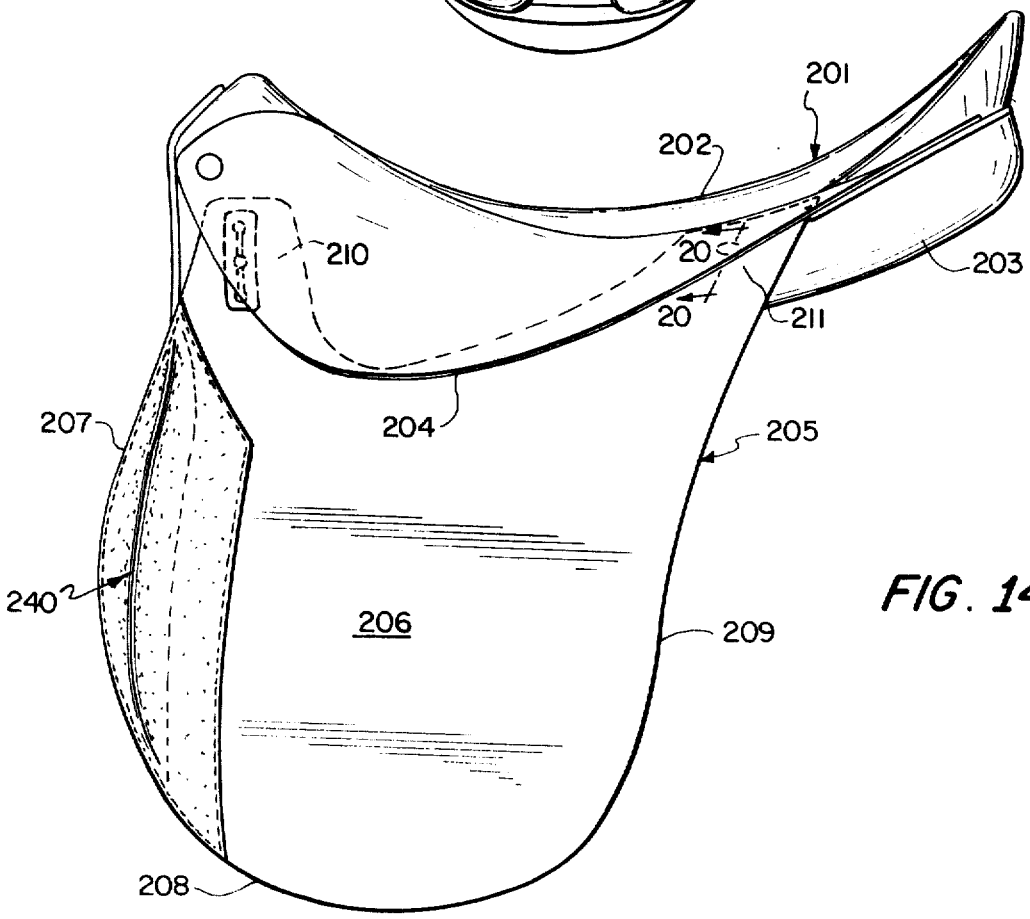
FIG. 14 is a view similar to FIG. 2 of a saddle constructed in accordance with the embodiment of FIG. 1A.

As seen in FIGS. 2, 4 and 9, seat structure 51 also includes the usual padded seat body 61, skirts 62 and underlying padded panels indicated generally at 63. Side members 52 of the tree are enclosed within the padded seat body, and the tree also includes additional spring metal bows 64, FIG. 9, which extend generally lengthwise of the saddle.

Side flaps 70 are of relatively heavy leather and include a main body portion 71 which is defined by front edge 72, lower edge 73, rear edge 74 and upper edge 73*a*. Integral with main body 71 are front upper portion 75 and rear upper portion 76. Portion 75 is a relatively short, rounded tab projecting upwardly from the upper edge portion of main body 71 and equipped with a reinforcing grommet 77, FIGS. 3 and 6, which cooperates with a fastener 78, FIGS. 5 and 6, fastener 78 serving as a pivot pin. Portion 76 is wider and longer than portion 75 and is equipped with a plurality of cross-grommets 79.

Considering FIGS. 2 and 9, it will be understood that, in usual fashion, each skirt 62 is sewed to padded seat body 61 along line 80, the extreme front end of the skirt being secured to the tree, as by nail 81. The main body of the skirt thus depends from the seat structure and overlies the outer portion of the corresponding padded panel 63. For major portions of the length of panels 63, the panels are sewn to the leather cover of seat body 61, each along a line below the respective side member 52 of the tree. However, as seen in FIG. 4, the seam attaching the panel 63 to the seat body is interrupted for a distance slightly greater than the width of upper flap portion 76 so that flap portions 76 can be inserted through the space thus provided between the seat body and the respective panels 63. Accordingly, when flap 70 is in place, the front upper portion 75 is disposed beneath the frontal portion of skirt 62 and overlies front portion 59 of the corresponding stirrup bar, while rear upper portion 76 of the flap extends through the gap in the stitching which attaches panel 63 to seat body 61.

Fastener 78, FIG. 6, comprises a bolt member 85 and a nut member 86. To accommodate the fastener, a right cylindrical bore 87 is provided which extends completely through the tree head and the overlying front portion 59 of the stirrup bar. Bolt member 85 includes flanged head 88, a right cylindrical shank portion 89 dimensioned to be slidably embraced by the wall of bore 87, and an elongated threaded portion 90. Nut member 86 has flanged head 91 and a hollow shank 92, the outer diameter of the shank being such as to be slidably embraced by the wall of bore 87 and the shank being internally threaded to coact with portion 90 of the bolt member. Fastener 78 is used both to secure flap portion 75 to the seat structure, in this case to the tree, and to act as a pivot pin to define the pivotal axis about which the flap is adjusted. When installing the flap, bolt member 85 is inserted into bore 87 from the inner surface of the tree head, flap portion 75 is positioned to align grommet 77 with bore 87, and nut member 86 is inserted through the grommet and threaded onto the bolt member until a lock washer 93 is clamped between the nut and bolt members. With the fastener thus installed, a substantial portion of the right cylindrical outer surface of the shank of member 86 extends beyond bore 87 and is exposed to coact with grommet 77.

Figure 7:
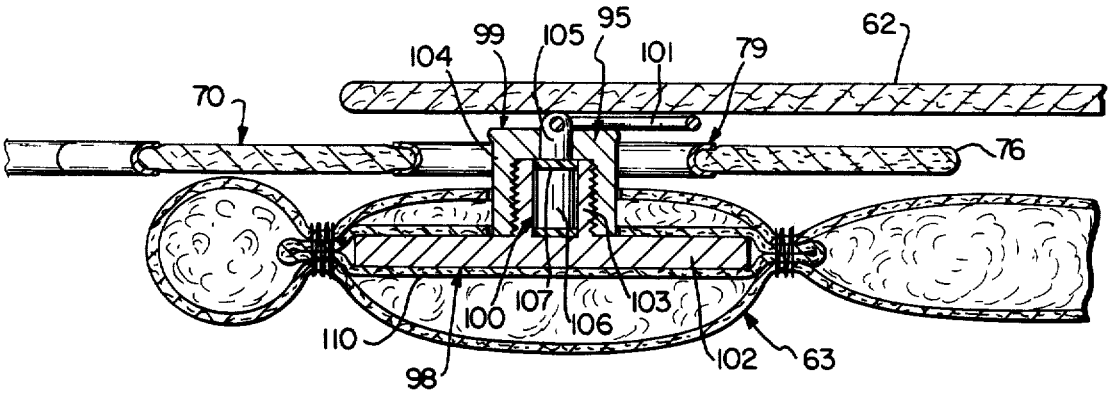
FIG. 7 is a fragmentary sectional view taken generally on line 7—7, FIG. 2.
Figure 8:
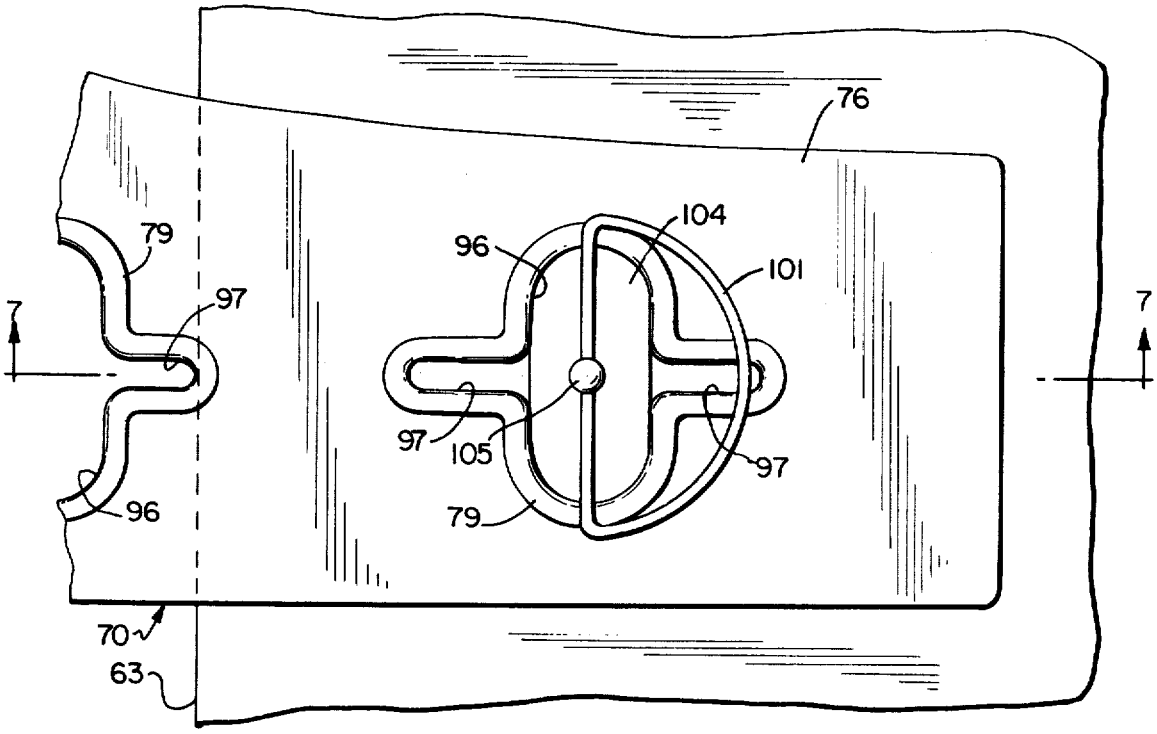
FIG. 8 is a fragmentary outer plan elevational view of the structure shown in FIG. 7.

Cross-grommets 79 coact with a releasable fastener 95, FIGS. 7 and 8, to releasably secure rear upper portion 76 of flap 70 to seat structure 51 in any of a plurality of positions relative to the seat structure. Grommets 79 are identical and each defines an elongated, generally rectangular opening 96 which extends through portion 76 and is disposed with its long axis lying on a line passing through the pivotal axis defined by fastener 78, and two openings 97 which are mutually opposed across the midpoint of opening 96 and at right angles to the long axis of that opening. In addition to grommets 79, the fastener comprises a male threaded member 98, secured to the panel 63, a female threaded member 99, a rotor 100 retained by members 98 and 99, and a retaining ring 101 pivotally attached to rotor 100. Male member 98 includes an enlarged flange 102 and a threaded stem 103. Female member 99 comprises a generally rectangular body 104 having a central bore which is threaded to cooperate with stem 103 of male member 98, and is centrally apertured to accommodate the stem 105 of rotor 100. Rotor 100 includes a cylindrical body 106 secured to stem 103 and clamped between two antifriction washers 107 when female member 99 is fully threaded onto stem 103.

Retaining ring 101 is so dimensioned that it cannot pass through grommet 79 except when the ring is rotated to the single position in which it is aligned with opposed openings 97. Male member 98 is secured to one of the padded panels 63, as by first enclosing flange 102 in shroud 110, FIG. 7, embedding the flange within the panel and then stitching through the panel to secure the shroud, and therefore male member 98, as shown. Thus, with the parts as shown in FIG. 7, and with ring 101 in the rotational position seen in FIG. 8, rear upper portion 76 of the flap is secured in a position relative to seat structure 51 determined by the choice of which one of the grommets 79 is engaged by fastener 95. Comparing FIGS. 2, 3 and 8, it will be apparent that, if the uppermost one of the three grommets 79 is chosen, flap 70 will be disposed in the forward position, shown by broken lines at 70*a* in FIG. 2, while choice of the lowermost one of grommets 79 will result in the rear position for the flap, indicated at 70*b* in FIG. 2, and choice of the intermediate one of the three grommets 79 will cause the flap to occupy the intermediate position shown in solid lines in FIG. 2. When the position of flap 70 is to be changed, skirt 62 is folded up and back, ring 101 is grasped and rotated into alignment with cross-slots 97 of grommet 79, and flap portion 76 is lifted to cause ring 101 to pass through slots 97 so that the flat can be pivoted to align another chosen grommet 79 with fastener 95. Ring 101 is then passed through the new grommet, rotated 90° and pivoted down flat against flap portion 76 to secure the flap in its newly adjusted position.

Referring to FIG. 4, it will be seen that the padded panels 63 are extended forwardly and downwardly to provide portions 63*a* which underlie the frontal portions of the respective flaps 70 and are secured thereto, as by stitching at 63*b*. The padded panels are resilient and flexible, comprising, e.g., wool padding enclosed in a soft leather covering. The forward portions of the panels are yieldably distorted, as the positions of the flaps are adjusted, and portions 63*a* therefore always remain in positions adjacent to the leading edges of the flaps to assure proper weight distribution for all adjusted positions of the flaps. To avoid undue stress from flexing of the forward portions of panels 63 as flaps 70 are adjusted from time to time, the panels are stitched at 111 and 112 to provide tapered corrugations capable of extending and contracting, transversely of the corrugations, as flexing occurs. Commonly referred to as extended panels, panels of the type indicated at 63 are conventional in, e.g., close contact saddles with flaps secured in a single, fixed position. When desired, the forwardly and downwardly extending portions 63*a* can be eliminated. Though, in prior-art usage, the downwardly and forwardly projecting portions 63*a* of the panels are not intended to provide the purpose of knee rolls, they do tend to provide an outward bulge adjacent the leading edge of the flap and, when employed as shown in FIGS. 2–11, remain adjacent the leading edge of the flap in all adjusted positions of the flap.

Figure 10:
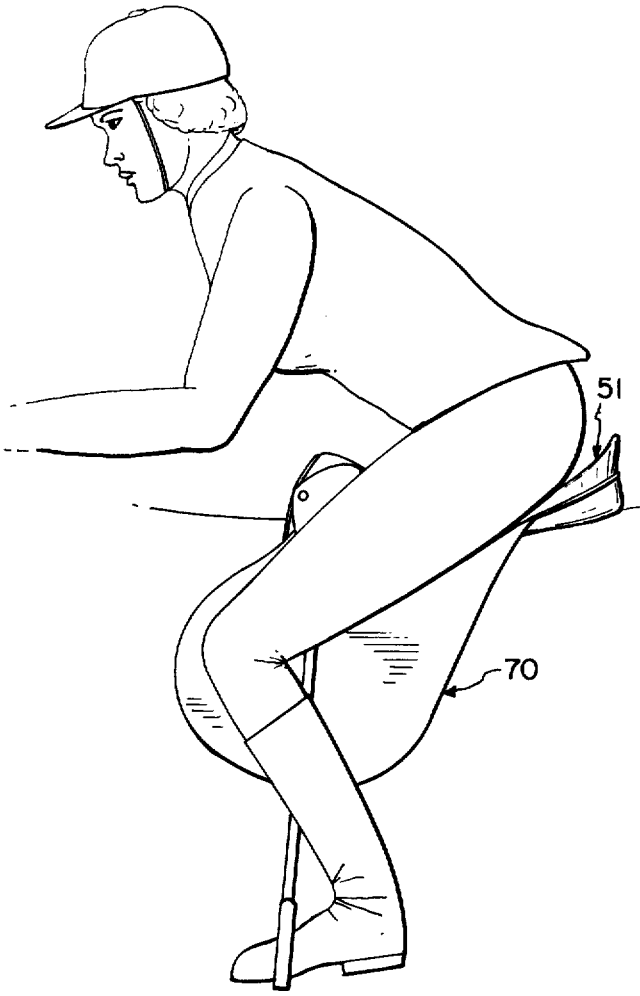
FIG. 10 is a diagram illustrating the saddle of FIGS. 2-9 with the flap adjusted to its forward position and a rider in place, with stirrups shortened for jumping.
Figure 11:
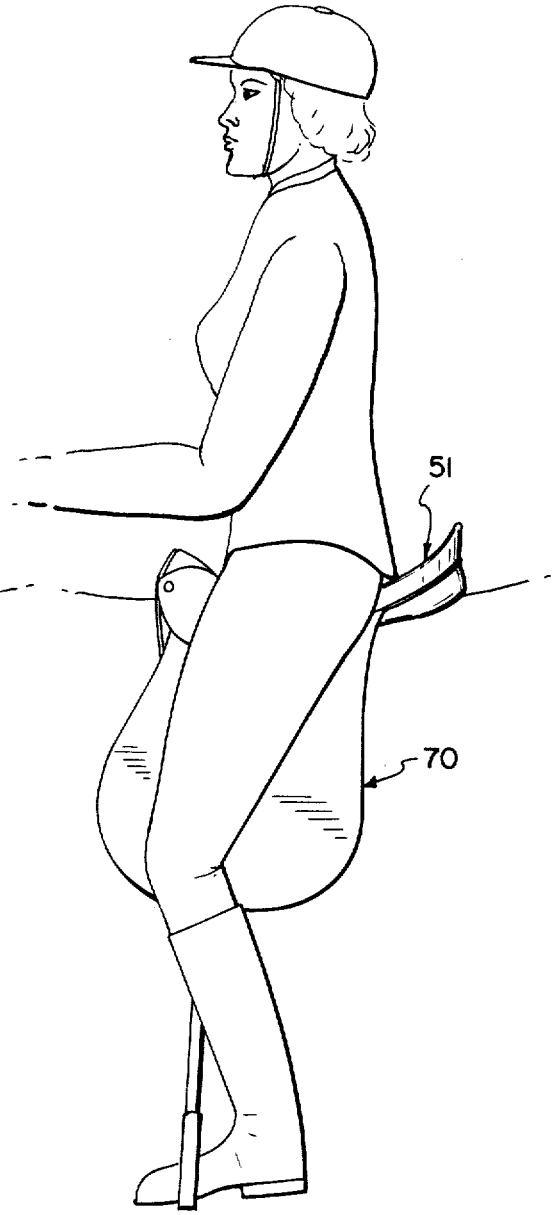
FIG. 11 is a diagram similar to FIG. 10 but with the flap adjusted to its rearward position and the stirrups lengthened for dressage.

The enlarged diagrams shown in FIGS. 10 and 11, similar to FIGS. 1–1C but with the rider added to the diagram, illustrate the relative positions of the rider's leg and the flap when the flap has been pivoted to its forward position (FIG. 10) and the stirrups shortened for jumping, and when the flap has been adjusted to its rearward position (FIG. 11) and the stirrups lengthened for dressage.

Figure 12:
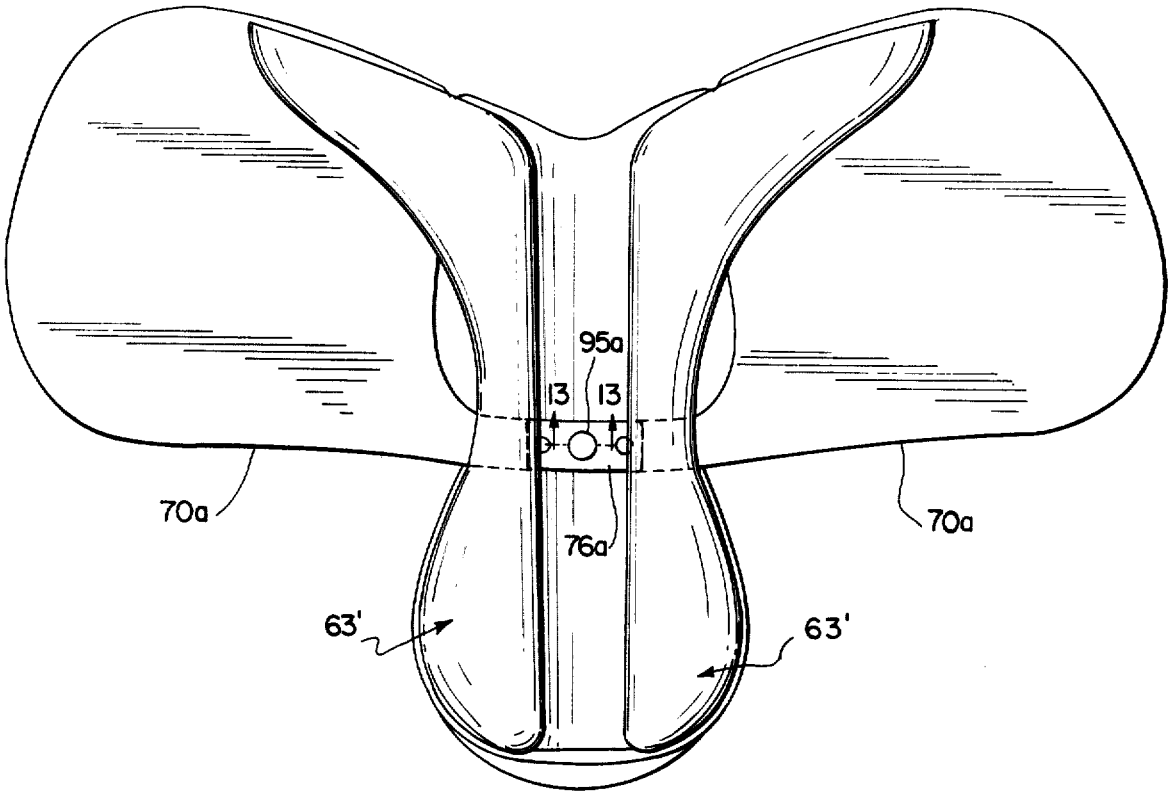
FIG. 12 is a bottom view, similar to FIG. 4, showing a modified form of the saddle of FIGS. 2-9.
Figure 13:
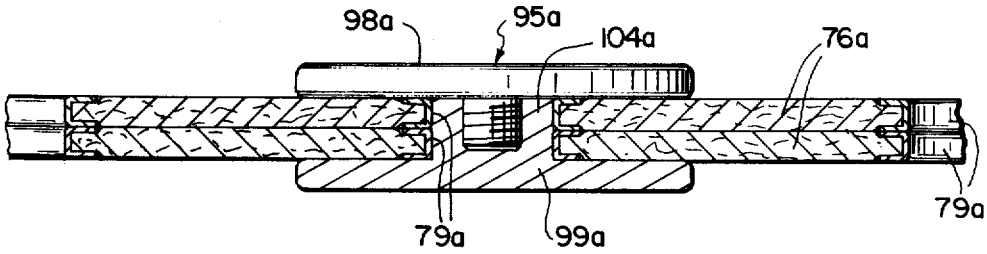
FIG. 13 is a fragmentary sectional view taken generally on line 13—13, FIG. 12.

The Modification of FIGS. 12 and 13

Since, in the saddle shown in FGS. 2–9, the rearward upper portions are led through gaps in the stitching which secures the padded panels to the seat structure, it is feasible to extend the rearward portions so that the ends of the two portions overlap, as seen at 76*a*, FIGS. 12 and 13, in the space between the two panels 63'. Flap portions 76*a* can then be equipped with simple circular grommets 79*a* and a simple threaded fastener 95*a* can be passed through aligned ones of the grommets and tightened to secure the two flap portions 76*a* to each other. Fastener 95*a* can comprise a flanged male threaded member 98*a* and a cooperating flanged female member 99*a*, as seen in FIG. 13, with the shank 104*a* of the female member presenting a right cylindrical outer surface of a diameter to be embraced by the grommets 79*a*. Since each flap portion 76*a* is disposed between one of the padded panels and one side member of the tree, securing the flap portions to each other effectively secures them to the seat structure.

The Embodiment of FIGS. 14–20

Figure 15:
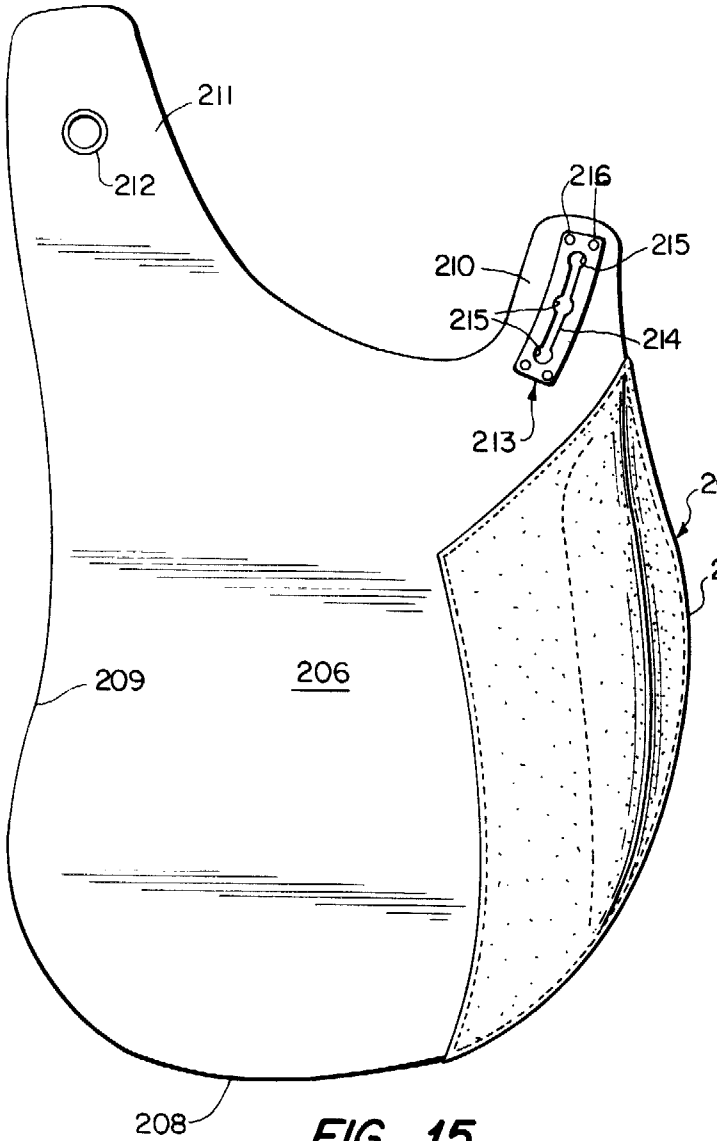
FIG. 15 is a plan elevational view of one of the flaps of the saddle of FIG. 14.
Figure 16:
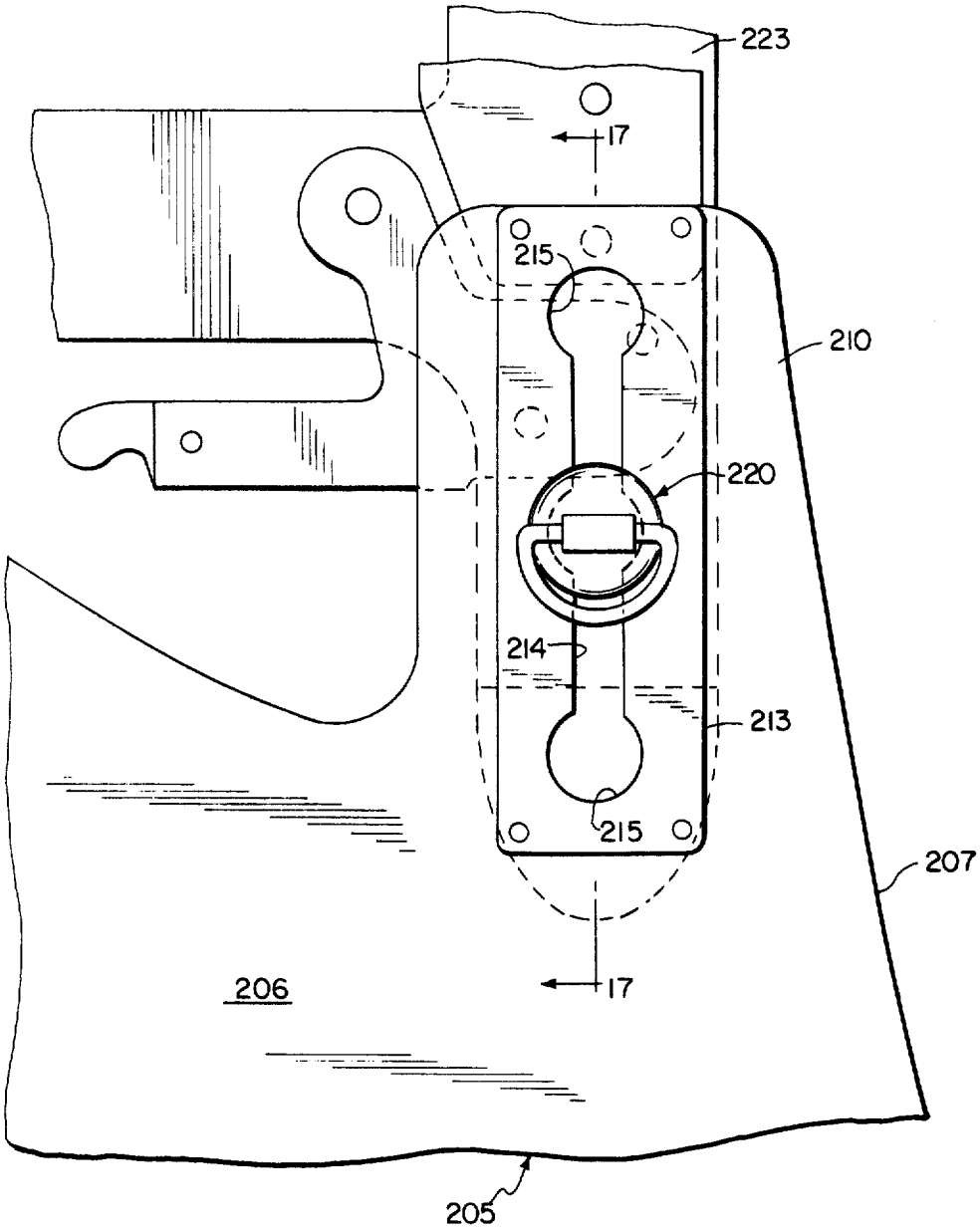
FIG. 16 is a fragmentary side elevational view similar to FIG. 5 illustrating the manner in which the forward portion of the flap shown in FIG. 15 is releasably fastened to the head portion of the saddle-tree.
Figure 17:
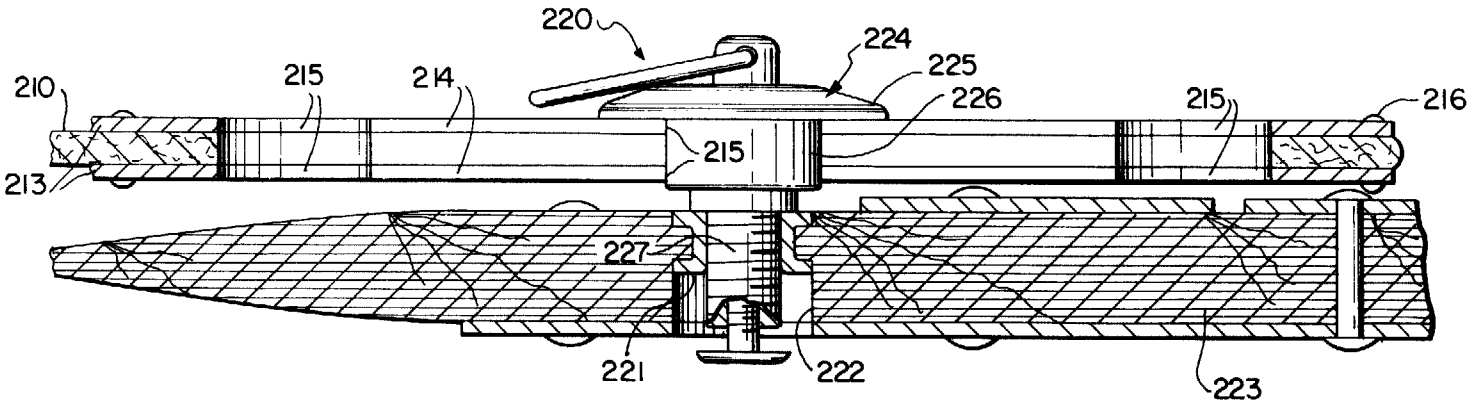
FIG. 17 is a fragmentary sectional view, enlarged with respect to FIG. 16 and taken generally on line 17—17, FIG. 16.

Constructed according to the embodiment illustrated diagrammatically in FIG. 1A, the saddle shown in FIGS. 14–20 comprises a seat structure 201 which includes a tree, a cushioned seat 202 constructed about the tree, padded panels 203, skirts 204 and side flaps 205. As seen in FIG. 15, each flap 205 has a flexible main body 206, a forward edge 207, a bottom edge 208, a rearward edge 209, a first upper tab-like portion 210 projecting upwardly from the forward portion of the flap, and a second upper tab-like portion 211 projecting upwardly from the rearward portion of the flap. Portion 211 is equipped with a circular grommet 212 which, as will be described with reference to FIG. 20, defines a pivotal axis for the flap. Front upper portion 210 of the flap is equipped with two identical fastener plates 213 each comprising, as seen in FIG. 15, an elongated slot 214 which is arcuate and lies on a circle of which grommet 212 defines the center. Slots 214 each have three circular edge portions 215, one at each end of the slot and one midway between the ends of the slot. Flap portion 210 is provided with an identical slot. The two plates are aligned so that respective ones of the circular edge portions of the two slots are coaxial, as seen in FIG. 17, with the slots in the plates registered with the slot in flap portion 210. The plates are secured rigidly to flap portion 210, as by rivets 216.

Figure 18:
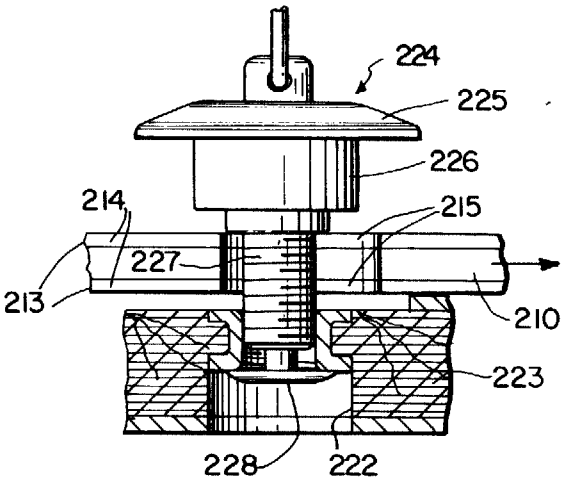
FIG. 18 is a fragmentary sectional view showing a portion of the structure shown in FIG. 17 but with the fastener in a position in which the flap is released for adjustment.

The combination of plates 213 coacts with a releasable fastener 220, FIGS. 16–18, to secure flap portion 210 in any of three pivotally adjusted positions defined by the circular edge portions 215. Fastener 220 comprises a threaded nut member 221 secured in a bore 222 through the head 223 of the saddle tree, and a bolt member 224. Bolt member 224 has a flanged head 225 of a diameter larger than circular edge portions 215, a short right cylindrical shank portion 226 of a diameter to be slidably embraced by circular edge portions 215, and a threaded portion 227 engaged with the threads of nut member 221. A retaining screw 228 is threaded and locked in the tip of portion 227, the head of screw 228 being of a diameter too large to pass through the nut-member, the bolt member thus being retained against escape, as seen in FIG. 18. Fastener 220 is assembled by aligning one set of circular edge portions 215 with bore 222 in the head, passing bolt member 224 through the slotted plates and flap portion 210, threading the bolt member into the nut member, and then installing retaining screw 228. With the fastener thus installed, bolt member 224 can be unscrewed to the position seen in FIG. 18, with shank portion 226 then no longer engaging circular edge portions 215, so that flap portion 210 can be adjusted to bring any desired one of the three apertures defined by edge portions 215 into registry with bore 222. The fastener is tightened, to secure flap portion 210 in its adjusted position, simply by threading the bolt member into the nut member until the relative positions seen in FIG. 17 are attained, shank portion 226 then being snugly embraced by the selected circular edge portions 215.

Figure 19:
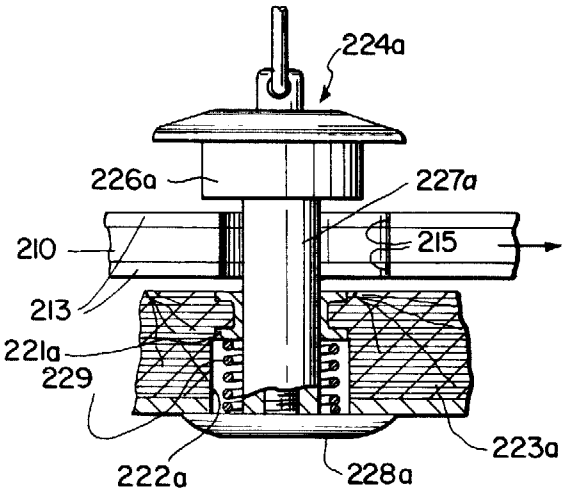
FIG. 19 is a view similar to FIG. 18 but illustrating a modified form of the fastener.

Alternatively, the fastener can be modified in the manner seen in FIG. 19, the nut member being replaced by a grommet 221*a* and portion 227*a* of movable fastener member 224*a* being without threads. A helical compression spring 229 is engaged between grommet 221*a* and the head of retaining screw 228*a*, as shown. Thus, the fastener can be released by pulling member 224*a* away from head 223*a* until shank portion 226*a* is no longer engaged in one of the apertures defined by circular edge portions 215. Once flap portion 210 has been adjusted to bring a new set of the circular edges 215 into registry with bore 222*a*, release of member 224*a* allows spring 229 to return the fastener to its engaged position, with shank portion 226*a* embraced by circular edge portions 215.

Figure 20:
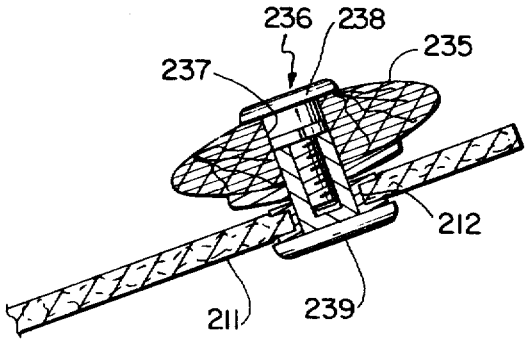
FIG. 20 is a fragmentary transverse cross-sectional view taken generally on line 20—20, FIG. 14.
Figure 3:
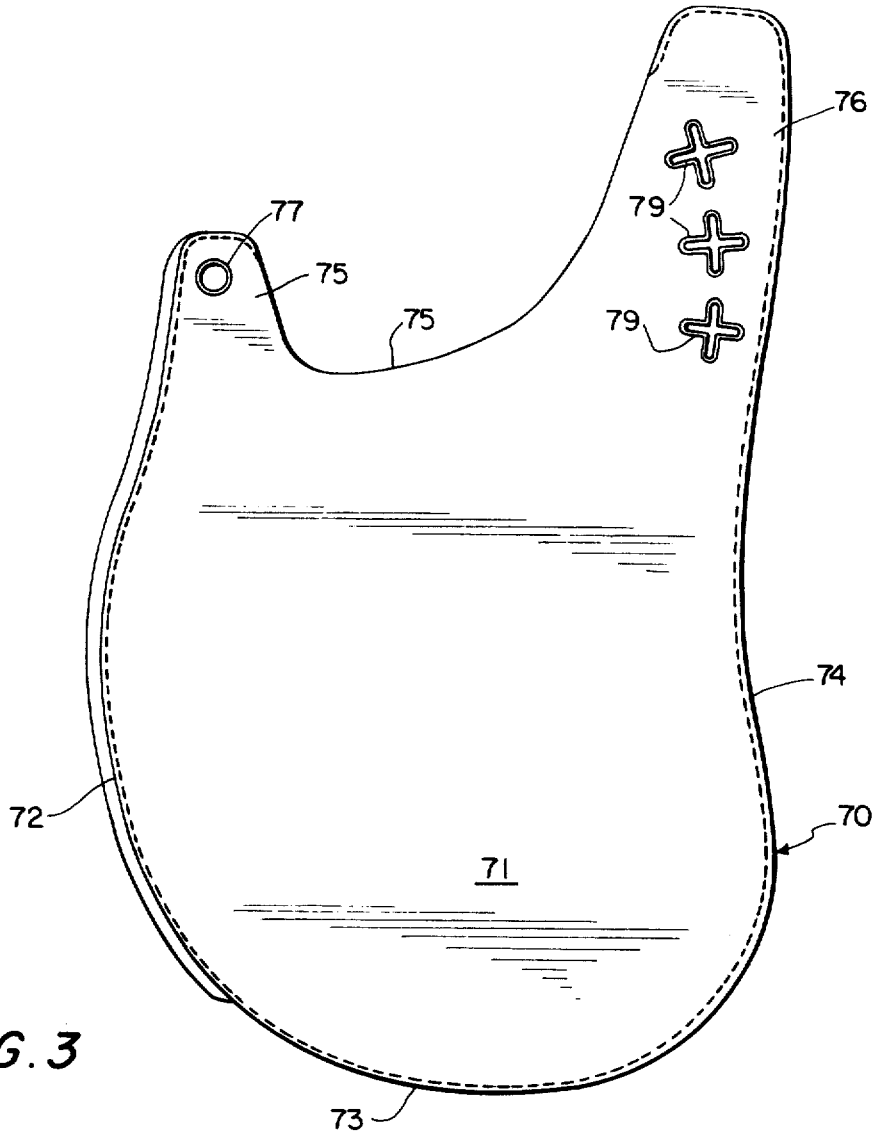
FIG. 3 is a plan elevational view of one of the flaps of the saddle of FIG. 2, the other panel being complementary to that seen in FIG. 3.

For each of flaps 205,, the corresponding side member 235, FIG. 20, of the tree is equippd with a fastener 236 which coacts with grommet 212 to both secure rearward upper flap portion 211 to the seat structure and define a pivotal axis about which flap 205 can be pivotally adjusted relative to the seat structure. Side member 235 has a bore 237 at right angles to the major transverse dimension of the side member. Fastener 236 includes a threaded bolt member 238 and a cooperating nut member 239, members 238 and 239 having the same general configuration and coacting in the same fashion as hereinbefore described with reference to fastener 78, FIG. 6. Thus, when fastener 236 is made up as shown in FIG. 20, the flanged head of member 239 underlies flap portion 211 and the right cylindical shank of the nut member is slidably embraced by grommet 212 so that, while flap portion 211 cannot be pulled away from side member 235, the flap portion is free to pivot relative to the tree.

Advantageously, flaps 205 are each equipped with an external knee roll 240, of any conventional form.

The Embodiment of FIGS. 21-25

In the embodiments of the invention described above, adjustment of the side flaps has been accomplished by providing for generally pivotal movement of the flap relative to the seat structure. Similar results can also be achieved by providing for generally rectilinear adjustment of the flaps relative to the seat structure, in the fashion illustrated in FIGS. 21-25. Here, the saddle comprises a seat structure 301 including a seat body 302, tree 303 and skirts 304. Two side flaps 305 are adjustably secured to the seat structure, each depending from a different side of the seat structure. Each flap 305 has a leading edge 306, a bottom edge 307, a trailing edge 308 and an upper edge 309. Upper edge 309 is but slightly curved and is of such shape that the forward portion 310 and the rearward portion 311 of the upper edge slant upwardly and forwardly at an angle a relative to the longitudinal axis of the saddle, angle a being in the range 15°-45°, advantageously 30°. The forward upper portion of the flap is adjustably secured to the head 312 of the tree by a fastener including plates 313. The rearward upper portion of the flap is similarly secured by a fastener including plates 314.

Figure 22:
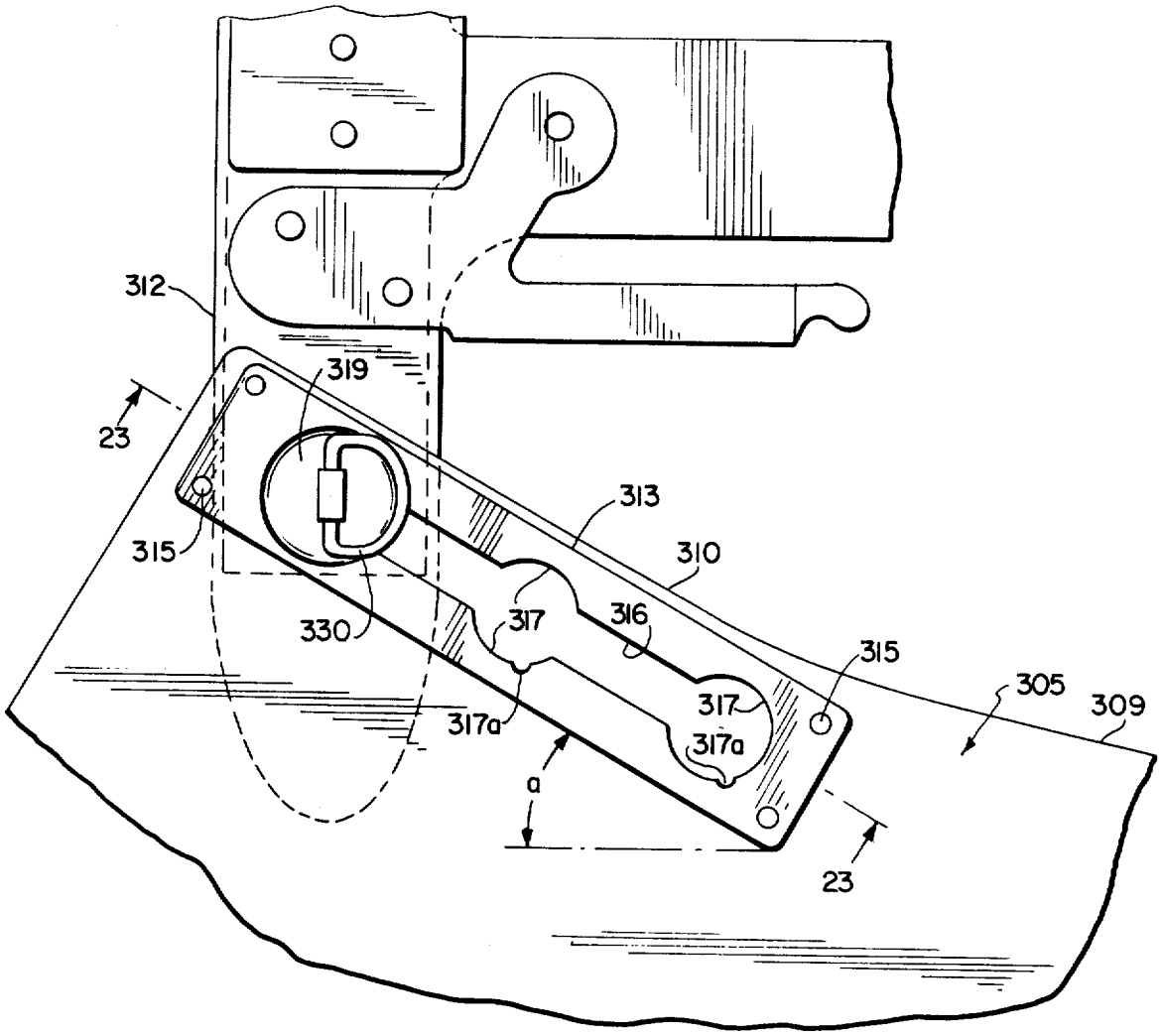
FIG. 22 is a view similar to FIG. 5 illustrating the manner in which a flap of the saddle of FIG. 21 is adjustably secured to the head of the saddle-tree.
Figure 23:
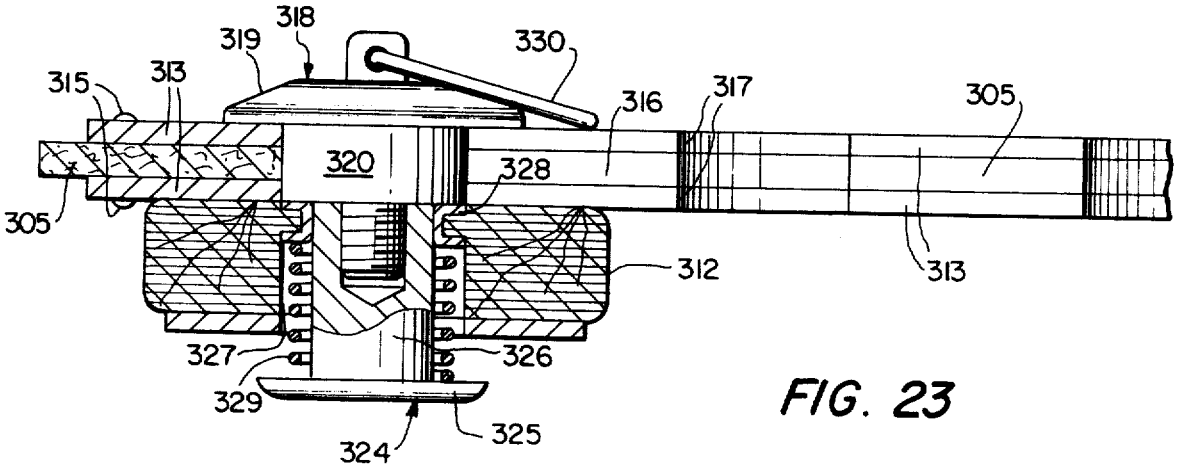
FIG. 23 is a fragmentary sectional view taken generally on line 23—23, FIG. 22, and enlarged with respect to that view.

As seen in FIGS. 22 and 23, two plates 313 are employed at the forward upper portion of each flap 305, the plates being disposed each on a different side of the flap portion and the resulting laminated structure being secured, as by rivets 315. Plates 313 and the portion of flap 305 lying therebetween have identical slots 316 each having three sets of circular edge portions 317, one at each end of the slot and one midway between the ends. Save for circular edge portions 317, slots 316 are straight and are inclined upwardly and forwardly at angle a. The fastener is completed by a movable fastener member 318 comprising a bolt member having an enlarged head 319, of a diameter larger than that of edge portions 317, a cylindrical shank 320 dimensioned to be slidably embraced by any selected set of edge portions 317, and an elongated threaded stem 321 of smaller diameter. Each fastener member 318 further includes a nut member 324 having an enlarged head 325 and an internally threaded tubular shank 326 presenting a right cylindrical outer surface. For each fastener, head 312 of the tree is provided with a through bore 327 of smaller diameter opening through the outer face of the head and larger diameter for a major portion of its length and opening through the inner face. A grommet 328 is fixed in the smaller diameter portion of the bore and has a diameter to sliably embrace shank 326 of member 324. The diameter of head 325 of the nut member is larger than the inner portion of bore 327. A helical compression spring 329 is engaged between grommet 327 and the head of the nut member and urges member 318 into the engaged position seen in FIG. 23 when the forward upper flap portion is so positioned that one of the three circular apertures defined by circular edge portions 317 is aligned with bore 327. The fastener is released, preparatory to adjustment of the flap relative to the seat structure, simply by grasping pull ring 330 and pulling member 318 to compress spring 329 until shank portion 320 escapes slot 316. Then, after the flap has been adjusted to bring a new aperture defined by edges 317 into registry with bore 327, member 318 is released, allowing the spring to return the fastener to the engaged position seen in FIG. 23.

At the rearward upper portion of each flap 305, two plates 314 are employed, these plates being identical to plates 313 so as to present straight elongated slots 340 each having circular edge portions 341 defining three apertures spaced along the slot, one aperture being at each end of the slot and another midway between the ends. Plates 314 are again secured to flap 305 by rivets 342, FIG. 24, with each plate on a different side of the material of the flap, the slots 340 being registered with each other and with an identical slot in the flap. A movable fastener member 343 is provided to coact with plates 314, the fastener member being carried by a bracket 334 secured to the corresponding side member 345 of tree 303, as shown, and including a flat dependent portion 346 having a through bore 347. Member 343 includes a bolt member 348 and a nut member 349. The bolt member includes a square head 350, an elongated shank 351 of a diameter to be slidably embraced by the wall of bore 347, and a threaded tip 352. Nut member 349 has a head 353, of a diameter significantly larger than edge portions 341, and an internally threaded shank 354 in which the threaded tip of the bolt member is engaged and which presents a right cylindrical outer surface dimensioned to be slidably embraced by any set of the circular edge portions 341, the shank being only slightly longer than the space between the outer faces of plates 314. A helical compression spring 355 is engaged between head 350 of the bolt member and the opposition face of bracket portion 346. A housing 356, riveted to bracket portion 334, is of square transverse cross section, encloses the spring and exposed portion of the bolt member, and slidably embraces the head of the bolt member to constrain the bolt member against rotation. Nut member 349 is equipped with a pull ring 357. It will be apparent that plates 314 and movable fastener member 343 constitute a fastener which opertes in the same fashion described for the fastener comrpising plates 313 and member 318, FIGS. 22 and 23.

Figure 24:
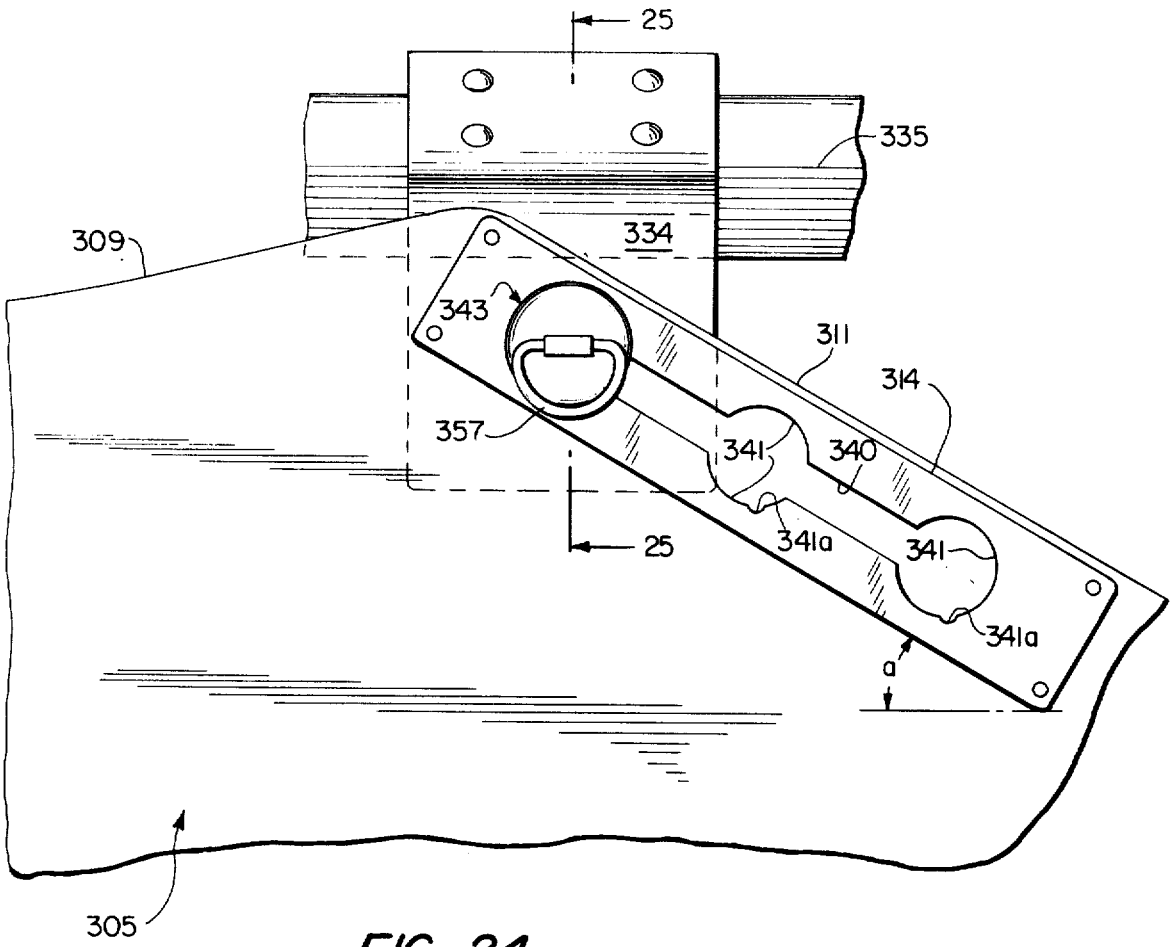
FIG. 24 is a fragmentary side elevational view illustrating a second fastener by which the flap of FIG. 22 is adjustably secured.
Figure 25:
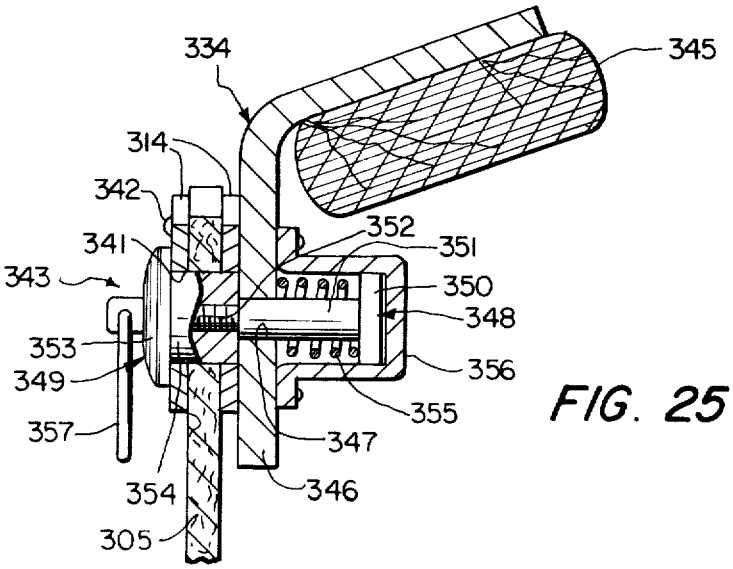
FIG. 25 is a fragmentary cross-sectional view taken generally on line 25—25, FIG. 24.

Since the two fasteners are to be held released at the same time to allow flap 305 to be moved upwardly and forwardly or downwardly and rearwardly, it is advantageous to provide each set of circular edge portions 317, 341 with a groove, as at 317*a*, FIG. 22, and 341*a*, FIG. 24, and to provide shank portions 320 and 354 with lateral axially extending ribs (not shown) to match the respective grooves, so that the fastener members will enter the apertures defined by the circular edge portions only when the movable fastener members are in one predetermined rotational position, the ribs holding the movable fastener members in their released condition for all other rotational positions.

Figure 21:
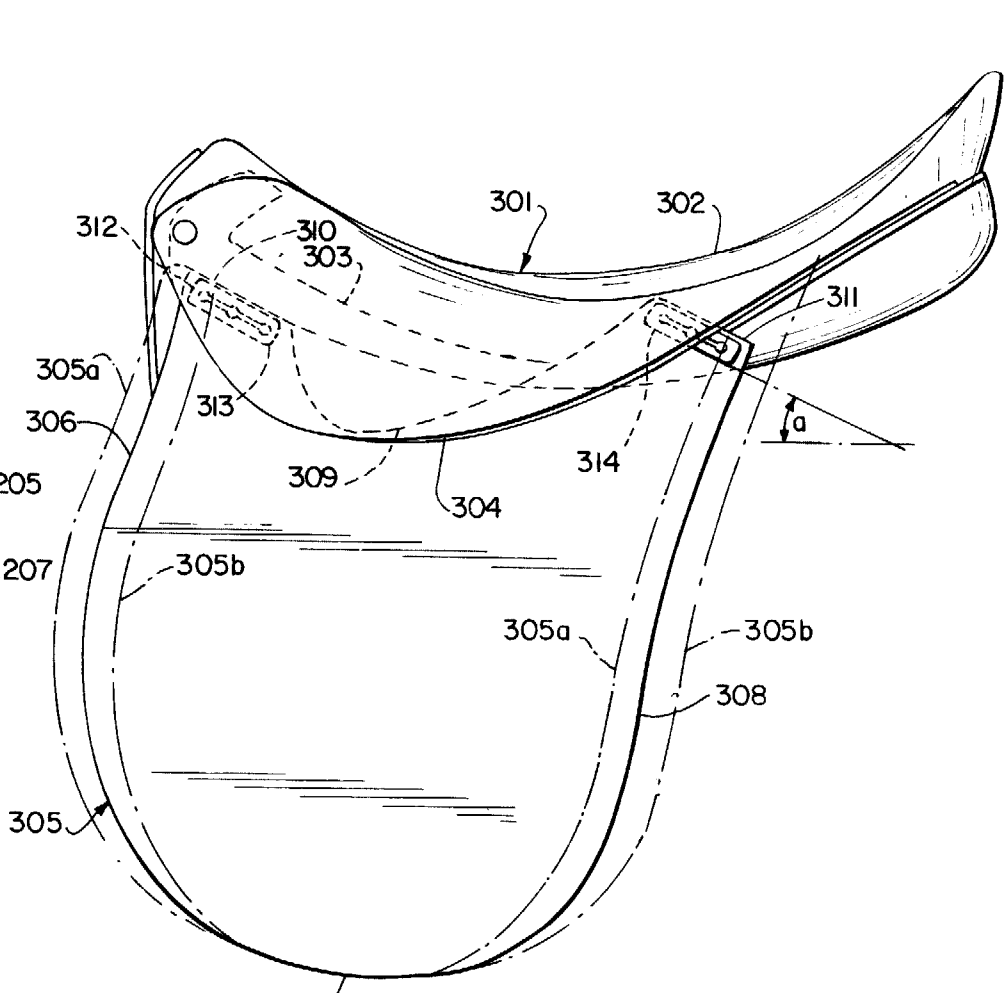
FIG. 21 is a view similar to FIG. 2 showing a saddle in accordance with another embodiment of the invention.

Since the slots 316, 340 are straight and are disposed at the same angle a, adjustment of the flap 305 to the forward position 305*a*, FIG. 21, involves bodily movement of the flap along a straight line upwardly and forwardly, thus placing the flap in the optimum position for jumping with shortened stirrups. Similarly, to adjust the flap to its rearward position 305*b*, the flap is moved bodily along a straight line downwardly and rearwardly. Thus, when the flap is adjusted to the position for jumping, the important forward portion of the flap is moved not only forwardly but also upwardly while, when the adjustment is to dressage position, the important rearward portion of the flap is moved not only rearwardly but also downwardly.

It is to be noted that, in the embodiment of FIGS. 21-25, flaps 305 are not only adjustable but also removable, by unthreading the nut and bolt members of the movable fastener members, so that the flaps can be removed from the seat structure and replaced or interchanged.

What is claimed is:

1. In a riding saddle of the English style suitable for competition riding, the combination of
   - a seat structure;
   - two flaps each depending from a different side of the seat structure and each comprising
     - a flexible main body portion adapted to lie between the corresponding side of the horse and the rider's leg, and
     - at least one upper portion; and
   - fastener means for each of the two flaps,
     - the fastener means for each flap including at least one releasable fastener and being constructed and arranged to secure at least one upper portion of the flap to the seat structure such that by releasing and reengaging the fastener means, with appropriate movement of the flap relative to the seat structure, the flap can be selectively secured and maintained in a forward position, appropriate for jumping with shortened stirrups, a rearward position, appropriate for dressage with lengthened stirrups, and at least one intermediate position, appropriate for pleasure and trail riding,
     - the main body portion of the flap being of such dimensions and configuration as to lie beneath the rider's leg when the flap is secured in any of said selected positions and the rider occupies a position in the saddle appropriate for the selected position.

2. The combination defined by claim 1, wherein
   - each of the flaps includes a first upper portion adjacent the forward edge of the flap and a second upper portion spaced rearwardly therefrom;
   - the fastener means for each flap comprises two fasteners which are spaced apart in a direction generally lengthwise of the saddle and each operatively associated with a different one of said first and second upper portions.

3. The combination defined by claim 1, wherein
   - the fastener means for each flap comprises two fasteners spaced apart in a direction generally lengthwise of the saddle,
   - the forward one of the fasteners comprising means allowing the flap to be adjusted relative to the forward one of the fasteners along a first arcuate line,
   - the rearward one of the fasteners comprising means allowing the flap to be adjusted relative to the rearward fastener along a second arcuate line,
   - said arcuate lines lying on a common circle having its center located between the two fasteners.

4. The combination defined by claim 1 wherein
   - each flap comprises a first upper portion adjacent the forward edge of the flap and a second upper portion spaced from the first upper portion in a direction generally lengthwise of the saddle; and
   - the fastener means for each flap comprises
     - a first fastener associated with the first upper portion, and
     - a second fastener associated with the second upper portion,
     - both of said fasteners being releasable and constructed and arranged to allow the flap to be moved bodily relat've to the seat structure along a line extending generally lengthwise of the saddle, when the fasteners are released, and to fix the flap to the seat structure when the fasteners are secured.

5. The combination defined by claim 4, wherein
   - the line of movement allowed by said fastener means when released is inclined upwardly and forwardly relative to the seat structure, whereby the space between the seat structure and the lower edge of the flap is smaller when the flap is in said forward position and greater when the flap is in said rearward position.

6. In a riding saddle, the combination of
   - a seat structure;
   - two flaps each depending from a different side of the seat structure and each comprising
     - a flexible main body portion adapted to lie between the corresponding side of the horse and the rider's leg, and first and second upper portions; and fastener means for securing each flap to the seat structure to maintain the flap selectively in a forward position, appropriate for jumping with shortened stirrups, a rearward position, appropriate for dressage with lengthened stirrups, and at least one intermediate position, appropriate for pleasure and trail riding, the fastener means for each flap comprising a first fastener associated with the first upper portion of the flap and defining a pivotal axis about which the flap as a whole can be pivoted, relative to the seat structure, between said forward position and said rearward position, and a second fastener associated with the second upper portion of the flap, said second fastener being releasable and constructed and arranged to secure the flap in any of said selected positions;

the main body portion of the flap being of such dimensions and configuration as to lie beneath the rider's leg when the flap is secured in any of said selected positions.

7. The combination defined by claim 6, wherein the first and second fasteners are spaced apart lengthwise of the saddle.

8. The combination defined by claim 7, wherein the first fastener is located adjacent the forward edge of the flap.

9. The combination defined by claim 8, wherein the second fastener is located adjacent the rearward edge of the flap.

10. The combination defined by claim 8, wherein the seat structure includes a tree; and the first fastener includes a fastener member extending through the head of the tree in a position above the tip of one of the points of the head of the tree.

11. The combination defined by claim 10, wherein the seat structure further comprises two stirrup leather bars each secured to the tree on a different side of the seat structure and each including a forward portion extending across the head of the tree, and said fastener member of the first fastener also extends through an opening in said forward portion of the corresponding stirrup leather bar.

12. The combination defined by claim 8, wherein the seat structure includes a tree, and two padded panels each underlying and extending along a different side member of the tree;

said second upper portion of each flap is an elongated tab-like portion projecting from the flap inwardly between the corresponding side member of the tree and the corresponding one of the two padded panels, said second upper portions of the two flaps overlapping each other in the space between the two padded panels; and said second fastener includes a fastener member extending through and securing together said second upper portions of the flaps.

13. The combination defined by claim 7, wherein the first fastener is located adjacent the rearward edge of the flap.

14. The combination defined by claim 12, wherein the seat structure includes a tree; and the first fastener includes a fastener member secured to the corresponding side member of the tree.

15. The combination defined by claim 14, wherein the second fastener includes a fastener member extending through the head of the tree in a position above the tip of one of the points of the tree.

16. The combination defined by claim 7, wherein the seat structure further comprises two stirrup leather bars each secured to the tree on a different side of the seat structure and including a forward portion extending across the head of the tree, and one of the first and second fasteners for the fastener means of each flap includes a fastener member which extends through an opening in said forward portion of the corresponding stirrup leather bar.

17. The combination defined by claim 6, wherein the seat structure further comprises a tree having a head and two padded panels each underlying a different side member of the tree; and one of said fasteners includes a fastener member secured to the corresponding one of the two padded panels.

18. The combination defined by claim 17, wherein the other of said fasteners includes a fastener member secured to the head of the tree.

19. The combination defined by claim 6, wherein one of said fasteners includes a fastener member secured to the corresponding one of the two side members of the tree.

20. The combination defined by claim 6, wherein the second fastener comprises a fastener member secured to the seat structure and having an exposed retaining portion of predetermined transverse cross section, and means secured to the flap and defining a plurality of apertures each of a shape and dimension to embrace the exposed retaining portion of the fastener member, the apertures being spaced apart generally along a circular line centered on said pivotal axis.

21. The combination defined by claim 20, wherein said means secured to the flap comprises at least one plate having an elongated slot, said slot including edge portions defining said apertures, and the flap having a slot corresponding to and registered with the slot of the plate.

22. In a riding saddle, the combination of a seat structure comprising a tree having a head;

two flaps each depending from a different side of the seat structure and each comprising a flexible main body portion adapted to lie between the corresponding side of the horse and the rider's leg, a first upper portion adjacent the forward edge of the flap, and a second upper portion spaced a substantial distance rearwardly from the first upper portion; and fastener means for each of the two flaps, the fastener means for each flap comprising a first fastener including a fastener member mounted on the head of the tree and a plate secured to said first upper portion of the flap and having an elongated slot through which the fastener member of the first fastener extends, and a second fastener including a fastener member mounted on the corresponding side member of the tree and a plate secured to the second upper portion of the flap and having an elongated slot through which the fastener member of the second fastener extends, both the first and second fastener being releasable and constructed and arranged to allow the flap to be moved bodily relative to the seat structure along a line extending generally lengthwise of the saddle, when the fasteners are released, to a selected forward position, appropriate for jumping with shortened stirrups, a selected rearward position, appropriate for dressage with lengthened stirrups, and at least one selected intermediate position, appropriate for pleasure and trail riding, and to secure the flap in any of said selected positions when the fasteners are secured, the main body portion of the flap being of such dimensions and configuration as to lie beneath the rider's leg when the flap is secured in any of said selected positions.

23. The combination defined by claim 22, wherein said slots are mutually parallel and inclined upwardly and forwardly.

* * * * *